United States Patent [19]

Bailey et al.

[11] 4,317,464

[45] Mar. 2, 1982

[54] ATRA LUBE HAIR LUBRICATING COMB

[76] Inventors: Gregory D. Bailey, c/o George Spector, 3615 Woolworth Bldg., 233 Broadway; George Spector, 3615 Woolworth Bldg., 233 Broadway, both of New York, N.Y. 10007

[21] Appl. No.: 154,807

[22] Filed: May 30, 1980

[51] Int. Cl.[3] ..... A45D 24/22

[52] U.S. Cl. ..... 132/113

[58] Field of Search ..... 132/112, 113, 114, 115, 132/116, 117; 222/527, 585, 282

[56] References Cited

U.S. PATENT DOCUMENTS

| | | | |
|---|---|---|---|
| 1,829,021 | 10/1931 | Sinclair | 132/113 |
| 2,184,478 | 12/1939 | Slaney | 132/116 |
| 2,849,009 | 8/1958 | Heinrich et al. | 132/116 |
| 3,027,052 | 3/1962 | Marraffino | 222/282 |
| 4,055,195 | 10/1977 | Moses | 132/115 |
| 4,090,522 | 5/1978 | Donley et al. | 132/112 |

*Primary Examiner*—Robert A. Hafer

[57] ABSTRACT

A comb that selectively can lubricate while combing the hair, the comb including a hollow backbone, a row of hollow teeth and integral with one edge of the backbone, and an enlarged, hollow, squeezable knob integral with an opposite edge of the backbone, a quantity of hair grease or pomade inside the backbone being forced out through the teeth when the knob is squeezed.

3 Claims, 4 Drawing Figures

31
33
32
30
17
34
18
13
14
15
12

21
20
10
22
19
18
17
11
3
12
16
3

13
14
11
27
23
12

15
12
12

14
13
27
29
28
24
25
12
23
26

16
15

ATRA LUBE HAIR LUBRICATING COMB

This invention relates generally to hair combs.

It is well known that many persons use a pomade on their hair so as to improve its control and appearance, but applying this substance leaves the hands oily or greasy, as this is the usual way that it has been applied at this time.

Accordingly, it is a principal object of the present invention to provide a hair lubricating comb which dispenses the greasy pomade from the tips of its teeth so that it not be applied by hand, thus keeping hands grease-free.

Another object is to provide a hair lubricating comb which makes it easy to apply the pomade without parting the hair, so as to reach the hairs near the scalp.

Figure 4:
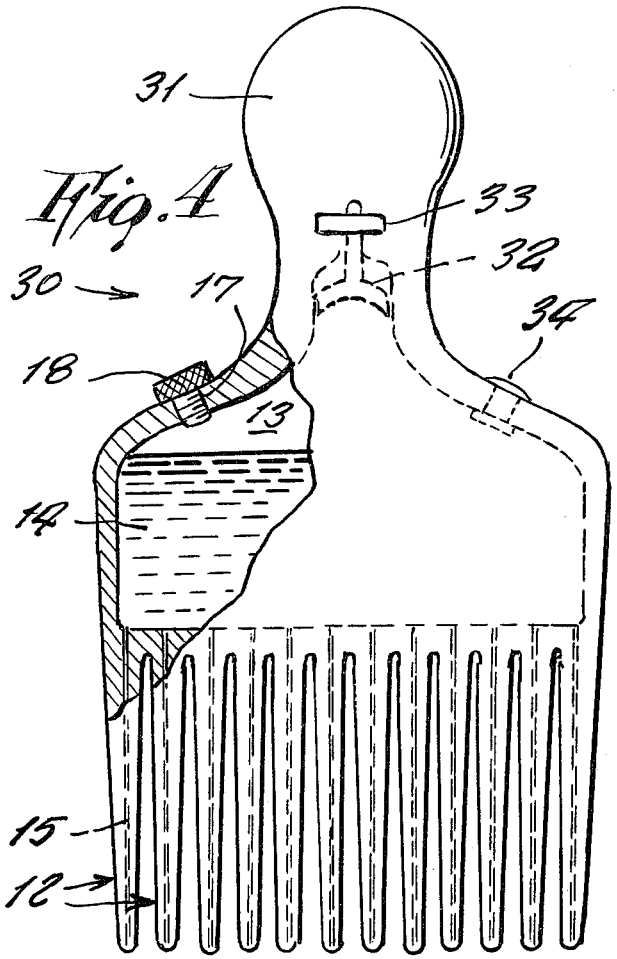
FIG. 4 is a side view of another design of the invention, in which a pump substitutes the top one way valve and the knob is not squeezeable, the lower one way valve being on the grease chamber.
Figure 1:
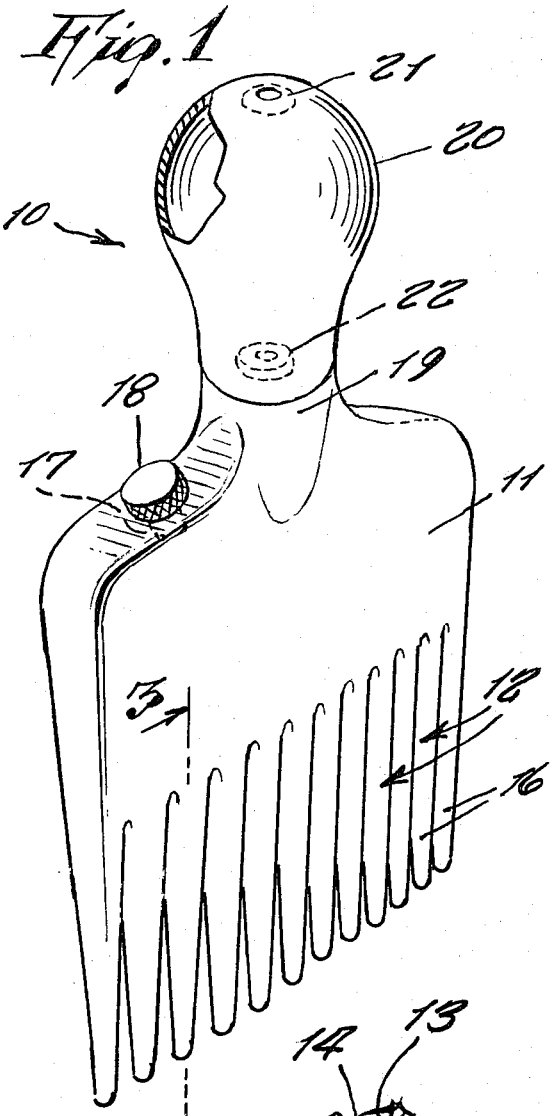
FIG. 1 is a perspective view of one design of the invention in which the knob is of resilient rubber so to be squeezable, a one way air valve at the upper and lower ends of the knob forcing air into the lubricant chamber, so when compressed, the lubricant grease is squeezed out the holes at the top of the teeth.
Figure 2:
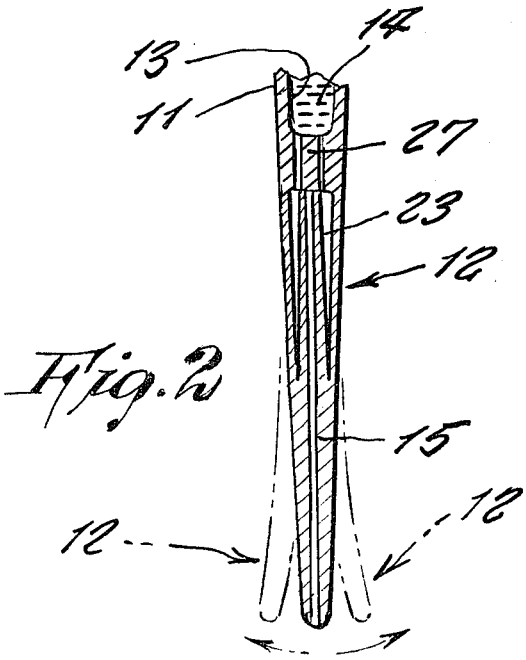
FIG. 2 is an enlarged cross sectional view of a typical tooth showing an internal construction whereby when the tooth is straight and not flexed, the opening in the tooth is closed so that grease cannot leak out, and showing in dotted lines that the tooth can be flexed to either side, so to allow the grease to flow through the tooth and out.
Figure 3:
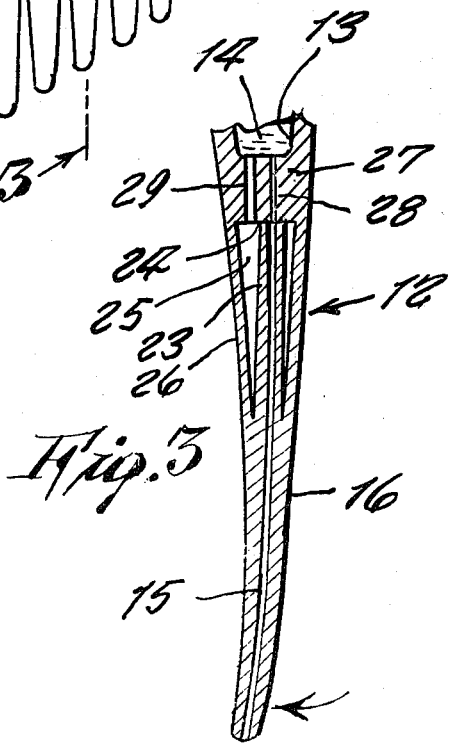
FIG. 3 is further enlarged cross sectional view of the tooth showing it flexed in one direction so to dispense a thin stream of grease, the tooth dispensing a thicker stream if flexed the other way, it being noted the teeth are flexed against the hair.

Referring now to the drawing in greater detail, and more particularly to FIGS. 1 through 3 thereof, at this time, the reference numeral 10 represents an atra lube hair lubricating comb, according to the present invention, wherein there is a flat, comb backbone 11 having a row of teeth 12 along one edge thereof, the backbone and teeth being molded together from a relatively hard plastic, similarly to that used in the manufacture of conventional combs, so that only the teeth may be slightly flexed, as shown in FIG. 3. In the present invention, the backbone is hollow by having a chamber 13 therein containing a greasy hair pomade 14 and which is dispensed therefrom through openings 15 in the teeth extending to the tooth tips 16.

An opening 17 on a shoulder of an opposite edge of the backbone serves for refilling the chamber with pomade, the opening being closable by a removable screw cap 18.

A stem 19 on a center of this opposite edge is fitted with a rubber squeeze bulb 20. A one way air valve 21 is on an end of the bulb, and a one way air valve 22 is on the stem, so that, in operative use, when the bulb is squeezed, air from the bulb enters the chamber so as to increase the air pressure therein and thus squeeze the pomade out through the teeth openings. When the bulb is released, air from the atmosphere enters the bulb through the valve 21.

Free leakage of pomade from the chamber is prevented, when the comb is not in use, by means of each tooth tip being made with a tapering nipple 23 extending toward the backbone and which abuts the backbone edge 24.

The nipple is contained inside a compartment 25 formed by a circular wall 26 that forms a base of the tooth and joins a longitudinal center of the tooth tip to the backbone. The nipple is free to oscillate side to side inside the compartment when the tooth tip is flexed in any direction. Thus when not flexed, as shown in FIG. 2, the nipple abutting the edge 24 of backbone chamber wall 27 is thus closed, so that no pomade from the chamber enters the tooth opening 15. However, when the tooth tip is flexed in a direction, as shown in FIG. 3, the nipple is correspondingly oscillated so that it aligns with a narrow opening 28 through which thus pomade from the chamber is slowly dispensed into the tooth opening 15. When the tooth tip is flexed in an opposite direction, the nipple aligns with a under opening 29 through wall 27 so that a larger pomade volume is dispensed to the tooth opening. All the narrow openings are on a same side of the edge 24, and all the wide openings are on an opposite side of this edge so that in use, all the teeth flexed together in a same direction, produce either a smaller or larger quantity of pomade dispensing.

In FIG. 3 another design of atra lube hair lubricating comb 30 does not include a rubber squeeze bulb, nor do the teeth include the oscillating nipple inside a compartment inside the tooth base. Instead, a spherical knob 31 is made integral with the backbone, the knob containing an air pump 32 operated by a button 33 so to pump outside air into the chamber through a one way valve 34. Also each tooth simply comprises a tapering member having the central hole 15 extending directly from the chamber to the terminal tip end of the tooth.

In use, the comb is first combed in a vertical position through the hair. Then it is combed in a generally horizontal or inclined position across the head, squeezing the bulb or pumping pump button during the combing operation, so to quickly and easily apply the pomade to the hair.

While various changes may be made in the detail construction, it is understood that such changes will be within the spirit and scope of the present invention as is defined by the appended claims.

What is claimed:

1. A hair lubricating comb, comprising in combination, a flat comb backbone having a row of teeth extending forwardly from a front side, a chamber inside said backbone rearward of said front side containing a hair pomade, an opening in each tooth communicating with said chamber extending to a terminal tip of each tooth for dispensing said pomade from said chamber, said chamber including means for increasing air pressure inside said chamber, said teeth and chamber having coacting means whereby flexing of said teeth controls the amount of pomade flowing into said teeth, wherein said chamber has walls integral and contiguous with said teeth.

2. The combination of claim 1 wherein the first said means comprises a hollow squeezable knob and contiguously extending centrally from said backbone chamber having valve means communicating with said chamber whereby squeezing said knob causes pressure increase in said chamber.

3. The combination of claim 2 wherein the second said means comprise a nipple within each tooth surrounding each said opening in combination with separated conduits in said front side communicating with said chamber wherein flexing of the teeth aligns the nipple with one conduit.

* * * * *